United States Patent [19]

Daar et al.

[11] Patent Number: 4,983,175

[45] Date of Patent: Jan. 8, 1991

[54] DEPILATORY DEVICE

[76] Inventors: Yair Daar, Moshav Galia; Shimon Yahav, 90 Tchernokovsky Street, Rehovot, both of Israel

[21] Appl. No.: 405,888

[22] Filed: Sep. 11, 1989

[30] Foreign Application Priority Data

Sep. 22, 1988 [IL] Israel ..... 87833

[51] Int. Cl.[5] ..... A61B 17/00

[52] U.S. Cl. ..... 606/133

[58] Field of Search ..... 606/133; 17/11.1 R, 17/47

[56] References Cited

U.S. PATENT DOCUMENTS

| | | |
|---|---|---|
| 1,232,617 | 7/1917 | Shipp . |
| 1,743,590 | 1/1930 | Binz . |
| 1,875,980 | 9/1932 | Bingham . |
| 1,923,415 | 8/1933 | Bingham . |
| 2,083,380 | 6/1937 | Hudson . |
| 2,112,230 | 3/1988 | Fisher . |
| 2,423,245 | 7/1947 | Magnus . |
| 2,458,911 | 1/1949 | Kerr . |
| 2,486,616 | 1/1949 | Schubiger . |
| 2,496,223 | 1/1950 | Lanzisera . |
| 2,592,484 | 4/1952 | Smith . |
| 2,900,661 | 8/1959 | Schnell . |
| 3,150,409 | 9/1964 | Wilcox . |
| 3,613,690 | 10/1971 | Newell . |
| 3,911,530 | 10/1975 | Kalfsbeek et al. . |
| 4,079,741 | 3/1978 | Daar et al. . |
| 4,171,701 | 7/1977 | Walter . |
| 4,279,253 | 4/1979 | Haes . |
| 4,524,772 | 6/1985 | Daar et al. . |
| 4,575,902 | 3/1986 | Alazet . |
| 4,726,375 | 2/1988 | Gross et al. . |
| 4,807,624 | 2/1989 | Gross et al. . |
| 4,825,867 | 5/1989 | Gross et al. . |
| 4,830,004 | 5/1989 | Alazet . |

FOREIGN PATENT DOCUMENTS

| | | |
|---|---|---|
| 2650969 | 6/1977 | Fed. Rep. of Germany . |
| 845847 | 12/1987 | Fed. Rep. of Germany . |
| 667265 | 10/1929 | France . |
| 788130 | 10/1935 | France . |
| 1017490 | 12/1952 | France . |
| 1123971 | 10/1956 | France . |
| 1151495 | 1/1958 | France . |
| 2245314 | 4/1975 | France . |
| 2307491 | 11/1976 | France . |
| 2334320 | 7/1977 | France . |
| 2454283 | 11/1980 | France . |
| 2556939 | 6/1985 | France . |
| 2598067 | 5/1986 | France . |
| 179261 | 12/1935 | Switzerland . |
| 268696 | 9/1950 | Switzerland . |
| 652899 | 12/1985 | Switzerland . |
| 203970 | 9/1923 | United Kingdom . |
| 225445 | 12/1924 | United Kingdom . |

*Primary Examiner*—Michael H. Thaler

*Attorney, Agent, or Firm*—Helfgott & Karas

[57] ABSTRACT

An electrically powered depilatory device including a hand held portable housing, a hair engagement and removal assembly including elongate elements in mutually twisted engagement and a motor for driving the elongate elements in motion, whereby hair is engaged between the elongate elements and thus removed.

36 Claims, 10 Drawing Sheets

DEPILATORY DEVICE

FIELD OF THE INVENTION

The present invention relates to depilatory devices and techniques generally and more particularly to powered mechanical depilatory devices.

BACKGROUND OF THE INVENTION

Various types of mechanical depilatory devices have been proposed and are known in the marketplace.

In applicants' U.S. Pat. No. 4,524,772 there is described an electrically powered depilatory device including a hand held portable housing, motor apparatus disposed in the housing, and a helical spring comprising a plurality of adjacent windings arranged to be driven by the motor apparatus in rotational sliding motion relative to the skin bearing hair to be removed, the helical spring including an arcuate hair engaging portion arranged to define a convex side whereat the windings are spread apart and a concave side corresponding thereto whereat the windings are pressed together, the rotational motion of the helical spring producing continuous motion of the windings from a spread apart orientation at the convex side to a pressed together orientation at the concave side for engagement and plucking of hair from the skin, whereby the surface velocities of the windings relative to the hair greatly exceed the surface velocity of the housing relative thereto.

The above-described device has met with very considerable commercial success throughout the world. The Background of the Invention section of U.S. Pat. No. 4,524,772 describes the most relevant prior art relative thereto including, U.S. Pat. Nos. 1,232,617; 1,743,590; 2,458,911; 2,486,616; 2,900,661 and 4,079,741 and Swiss Pat. Nos. 179,261 and 268,696.

SUMMARY OF THE INVENTION

The present invention seeks to provide a mechanical depilatory device which differs from the prior art devices described above and which provides efficient and relatively painless hair removal.

There is thus provided in accordance with a preferred embodiment of the present invention an electrically powered depilatory device including a hand held portable housing, a hair engagement and removal assembly including elongate elements in mutually twisted engagement, and motor apparatus for driving the elongate elements in motion, whereby hair is engaged between the elongate elements and thus removed.

Additionally in accordance with a preferred embodiment of the invention, the action of the mutually twisted elongate elements when driven by the motor apparatus is to wind hair in engagement therewith.

Further in accordance with an embodiment of the invention, the motion of the elongate elements is such that the hair is wound in engagement with the elongate elements at a location separated from the location at which it is initially engaged thereby.

In accordance with a preferred embodiment of the present invention, the elongate elements form part of a single endless loop. Alternatively, the elongate elements may be embodied in two or more separate endless loops.

Further in accordance with a preferred embodiment of the invention, the motor apparatus is operative to draw the elongate elements through the twisted engagement, whereby given regions of the elongate elements enter mutually twisted engagement and subsequently leave such engagement. Normally the locations at which given regions of the elongate elements enter and leave mutually twisted engagement are spaced from each other.

In accordance with a preferred embodiment of the invention, the arrangement of the elongate elements in mutually twisted engagement and the driving thereof by the motor apparatus is such that the elongate elements move forward in a generally spiral type motion and rotate about their elongate axes as they move through mutually twisted engagement.

In accordance with a preferred embodiment of the invention, the arrangement of the elongate elements in mutually twisted engagement is such that when driven by the motor apparatus, the engagement and removal assembly undergoes continuous twisting action.

Further in accordance with a preferred embodiment of the invention, the arrangement of the engagement and removal assembly is such that the location of the twisted engagement remains generally static relative to the housing.

Additionally in accordance with a preferred embodiment of the invention the twisted engagement comprises multiple coils, preferably at least two in number.

In accordance with an embodiment of the invention the arrangement of the engagement and removal assembly is such that the twisted engagement extends generally linearly.

Further in accordance with an embodiment of the invention, the twisted engagement is provided by twisting together elongate elements forming part of one or more endless loops. In this embodiment, the elongate elements are maintained in the twisted engagement by means of rollers.

Alternatively, the twisted engagement is provided by twisting together elongate elements and subsequently joining them to form one or more endless loops. In this embodiment rollers are not needed to maintain the elongate elements in twisted engagement.

BRIEF DESCRIPTION OF THE DRAWINGS

The present invention will be understood and appreciated more fully from the following detailed description, taken in conjunction with the drawings in which.

DETAILED DESCRIPTION OF THE INVENTION

Figure 1B:
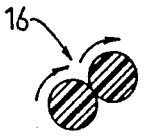
FIG. 1B is a sectional illustration of a portion of the device of FIG. 1A, taken along lines B—B.
Figure 1A:
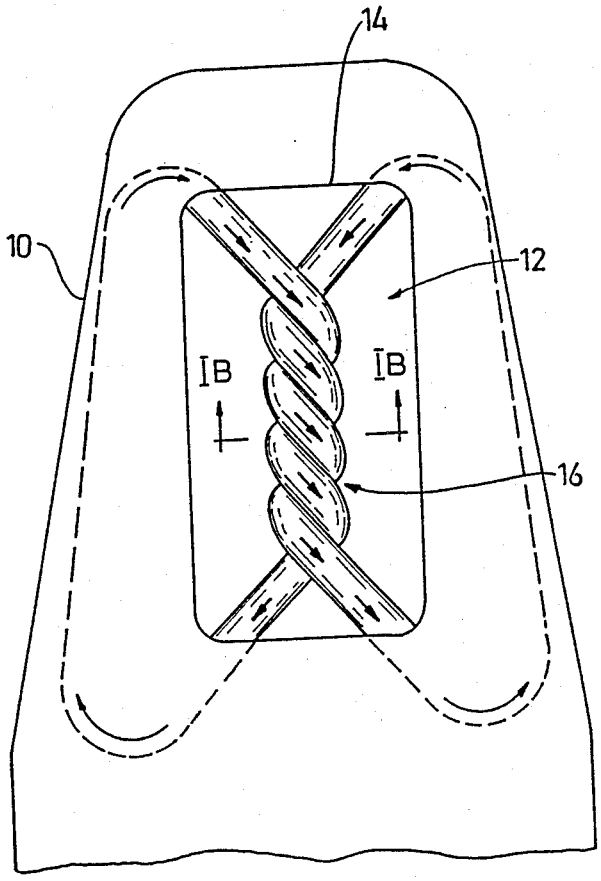
FIG. 1A is a pictorial illustration of a depilatory device constructed and operative in accordance with a preferred embodiment of the present invention.

Reference is now made to FIGS. 1A and 1B, which illustrate in respective plan and sectional view, a depilatory device constructed and operative in accordance with a preferred embodiment of the invention. The depilatory device comprises a hand-held portable housing 10 having formed therein a hair engagement and removal assembly 12, which is seen through an access opening 14 in housing 10.

In accordance with a preferred embodiment of the invention, the hair engagement and removal assembly 12 comprises elongate elements arranged in mutually twisted engagement, as seen at reference numeral 16. The elongate elements, which preferably form part of a single endless loop of flexible material, such as silicone rubber, are driven by means, not shown in FIGS. 1A and 1B, examples of which are described in detail hereinbelow, so as to enter, pass through and leave mutually twisted engagement, as indicated by the arrows in FIG. 1A. It will be appreciated that motion of the elongate elements in an opposite direction to that illustrated is also possible. The elongate elements may alternatively be formed of other materials such as plastics, other rubbers, and natural or synthetic fibers such as cotton. The elongate elements 16 are typically twisted and then subsequently joined to define the endless loop.

It will be appreciated that the driven motion of the elongate elements as they enter, pass through and leave mutually twisted engagement produces not only motion in the general direction of the elongate extent of the elements, as indicated by the arrows in FIG. 1A, but also produces rotation of the elements about their elongate extent, as illustrated, for example, by the arrows in FIG. 1B.

Figure 1C:
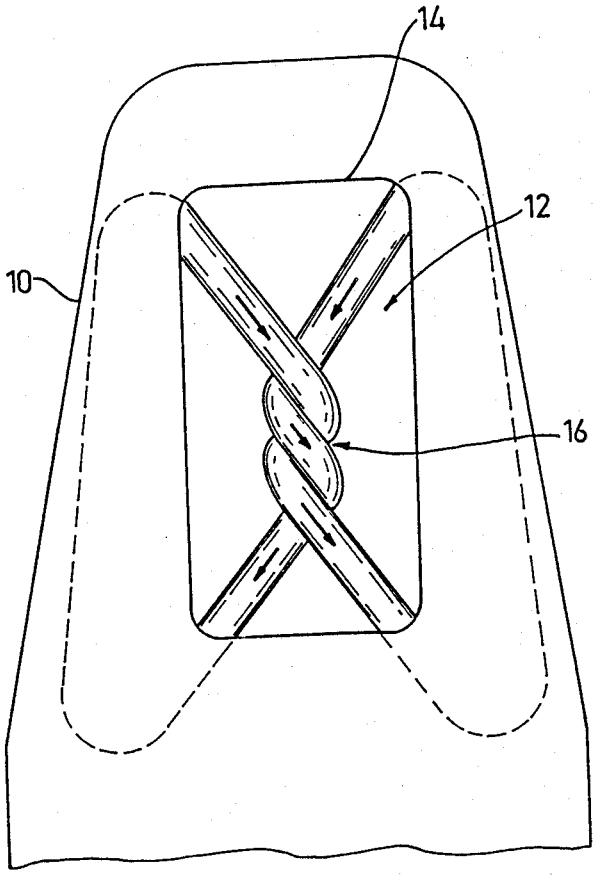
FIG. 1C is a pictorial illustration of a depilatory device constructed and operative in accordance with another preferred embodiment of the present invention.

FIG. 1C illustrates an alternative embodiment of the invention which is identical to that of FIGS. 1A and 1B except that the twisted engagement comprises only a single coil.

The motion of the elongate elements in mutually twisted engagement as illustrated is operative to engage hair between the elongate elements and to remove such hair from the skin. Two examples, which are not necessarily exclusive, of the operation of hair removal by the apparatus of FIGS. 1A and 1B are illustrated in FIGS. 2A–5C, in which the thickness of the hair is exaggerated for the sake of clarity.

Figure 3A:
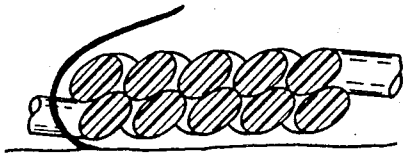
FIGS. 3A, 3B and 3C are three sectional illustrations corresponding to FIGS. 2A, 2B and 2C.
Figure 2A:
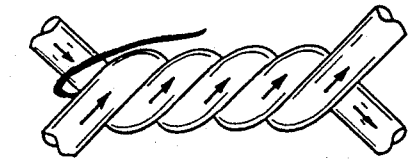
FIGS. 2A, 2B and 2C are three pictorial illustrations illustrating one example of the hair removal action of the depilatory apparatus of the present invention.

Reference is now made to FIGS. 2A, 2B, 2C, 3A, 3B and 3C which illustrate one example of hair removal action in accordance with the present invention. FIGS. 2A and 3A illustrate a hair about to be engaged in mutually twisted elongate elements, which are driven in the directions illustrated therein, including both motion along the elongate extent of the elements as illustrated by the arrows in FIG. 2A, and rotational motion of the elements as the enter, pass through and leave mutually twisted engagement.

Figure 3B:
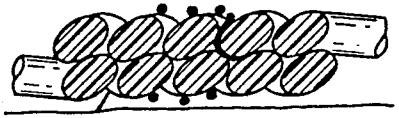
Figure 3C:
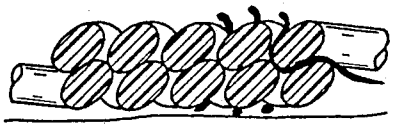
Figure 2B:
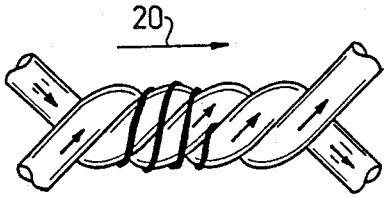
Figure 2C:
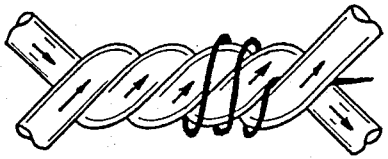

FIGS. 2B and 3B, illustrate the hair being wound in engagement with the mutually twisted elongate elements, as they progress in the general direction indicated by the arrow 20 in FIG. 2B. FIGS. 2C and 3C illustrate the wound hair after it has been removed from its root location in the skin and has moved forward in the general direction of the arrow 20 in FIG. 2B. The removed hair disengages from the elongate elements as they leave mutually twisted engagement.

It is noted that in the Example of FIG. 2A–2C and 3A–3C, the hair is wound about both of the mutually engaged elongate elements. This need not necessarily be the case.

Figure 5C:
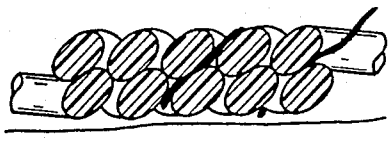
FIGS. 5A, 5B and 5C are three sectional illustrations corresponding to FIGS. 4A, 4B and 4C.
Figure 4C:
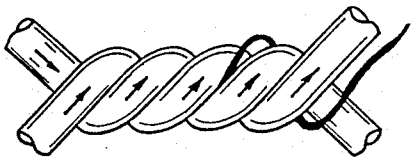
FIGS. 4A, 4B and 4C are three pictorial illustrations illustrating another example of the hair removal action of the depilatory apparatus of the present invention.
Figure 5B:
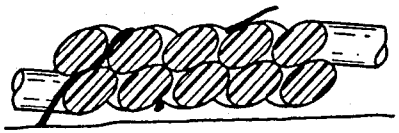
Figure 4B:
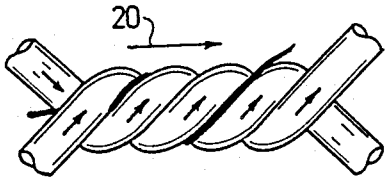
Figure 5A:
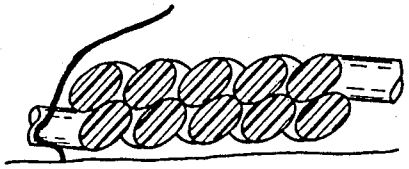
Figure 4A:
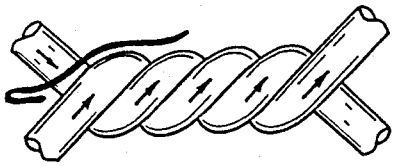

Reference is now made to FIGS. 4A, 4B, 4C, 5A, 5B and 5C which illustrate another example of hair removal action in accordance with the present invention. FIGS. 4A and 5A illustrate a hair about to be engaged in mutually twisted elongate elements, and correspond generally to FIGS. 2A and 3A.

FIGS. 4B and 5B illustrate the hair twisted together with the elongate elements, as opposed to being twisted thereover with the elongate elements, as opposed to being twisted thereover as shown in FIGS. 2B and 3B. FIGS. 3C and 5C, shown the wound hair removed from the root location on the skin and displaced from the root location.

It will be appreciated that the actual hair removal operation of the apparatus of the invention may vary depending on a variety of conditions, including inter alia, the type and length of hair, the speed at which the elongate elements move into and through mutually twisted engagement, the location at which the hair is engaged relative to the engagement and removal assembly and relative to the root location. Thus, either or both of illustrated types of hair removal action may take place and other types of hair removal action, not illustrated here, may also take place within the scope of the present invention.

It is a particular feature of the present invention that the hair engagement and removal assembly of the present invention is operative to remove hair by both winding it and displacing the wound hair from the root, thus resulting in double action hair removal.

Figure 6A:
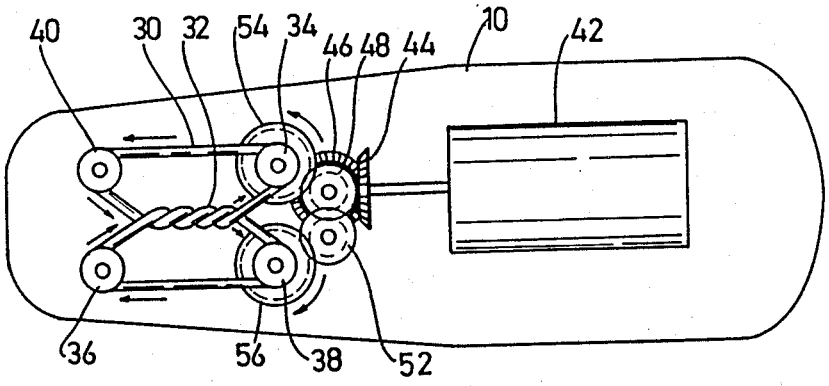
FIGS. 6A and 6B are respective plan view and side view illustrations of a depilatory device constructed and operative in accordance with a preferred embodiment of the invention.
Figure 6B:
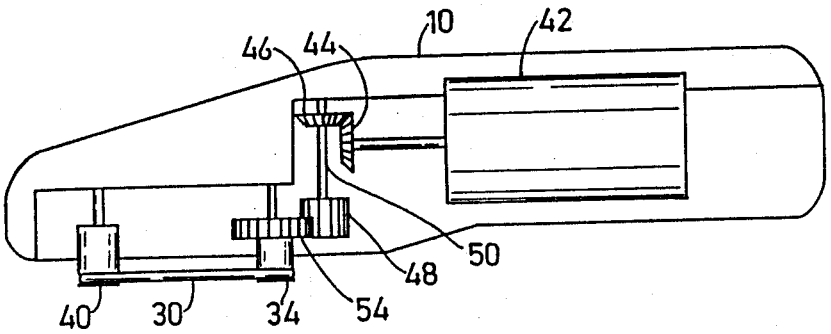

Reference is now made to FIGS. 6A and 6B which illustrate a preferred embodiment of the depilatory apparatus of the present invention. It will be appreciated that in FIGS. 6A–11, the entire hair engagement and removal assembly including the mounting and driving thereof is shown for the sake of clarity. In reality, parts of the hair engagement and removal assembly will be enclosed by the housing, as shown, for example in FIG. 1A.

In FIGS. 6A and 6B the hair engagement and removal assembly comprises a single endless loop 30. In the illustrated embodiment, the loop is configured to define a region 32 in which the two elongate elements or portions of the loop are engaged in mutually twisted engagement. Here a linear twisted engagement of two coils is shown. It is appreciated that alternatively non-linear twisted engagements, as well as twisted engagements having a greater or lesser number of coils may be provided.

Endless loop 30 is typically mounted at four corners onto rollers 34, 36, 38 and 40, as shown, which are rotatably mounted onto housing 10.

An electric motor 42, receiving power from a source of electric power, not shown, drives rollers 34 and 38 in opposite directions, as illustrated, typically by means of engaging bevel gears 44 and 46, a drive gear 48 connected to bevel gear 46 by a shaft 50, a reversing gear 52, and roller drive gears 54 and 56, which drive respective rollers 34 and 38 and are driven by respective gears 48 and 52.

Figure 7A:
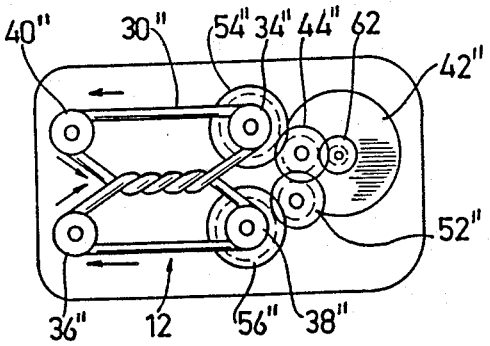
FIGS. 7A and 7B are respective plan view and side view illustrations of a depilatory device constructed and operative in accordance with another preferred embodiment of the invention.
Figure 7B:
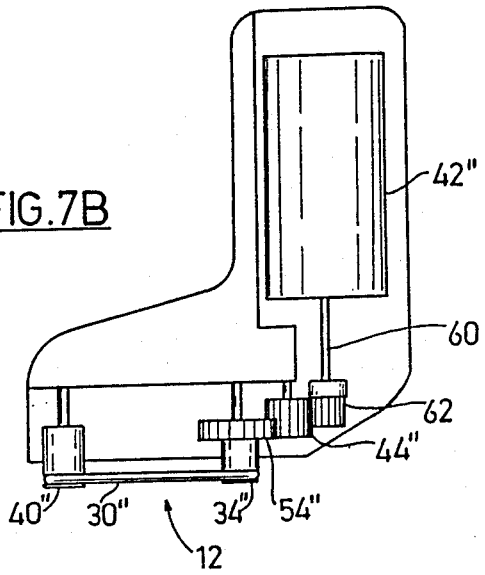

Reference is now made to FIGS. 7A and 7B which illustrate a depilatory device similar in operation to that of FIGS. 6A and 6B but different in configuration, in that a generally upright housing is employed and a motor output shaft 60 lies in a plane generally perpendicular to that of the hair engagement and removal assembly 12. The hair engagement and removal assembly 12 may be identical to that shown in FIGS. 6A and 6B and is here identified by identical reference numerals added with double primes. The gear connections to the motor are somewhat simplified, in that the bevel gears are eliminated and a motor output drive gear 62 directly engages gear 44', which, in turn, drives gears 52 and 54'.

Figure 8:
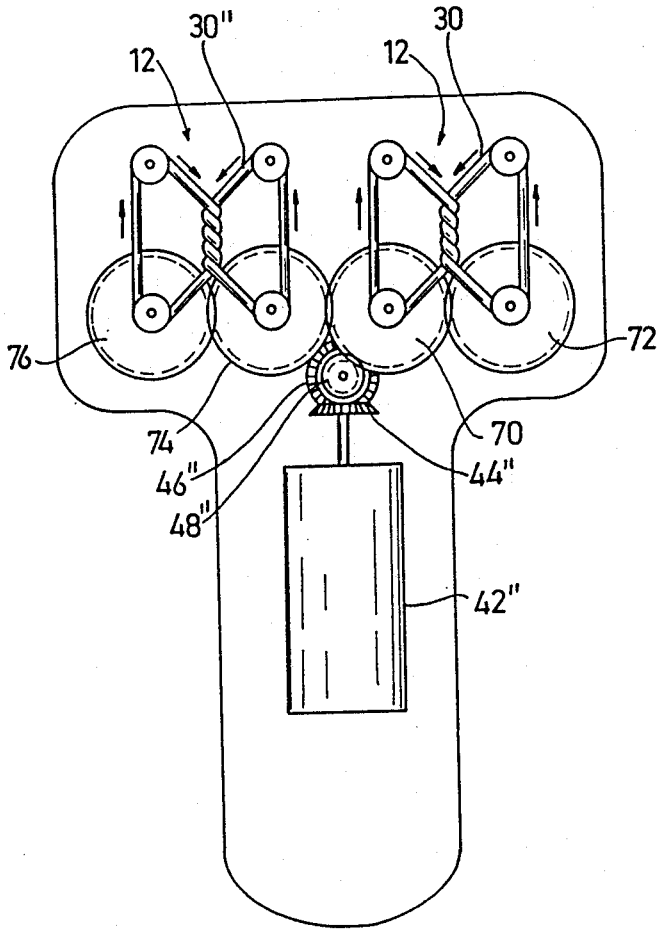
FIG. 8 is a plan view illustration of a depilatory device constructed and operative in accordance with yet another preferred embodiment of the invention.

Reference is now made to FIG. 8, which illustrates a depilatory device which may be identical to that of FIGS. 6A and 6B but has two hair engagement and removal assemblies 12, rather than a single such assembly as in the embodiment of FIGS. 6A and 6B. A motor 42 drives both assemblies 12 via bevel gears 44" and 46" and a drive gear 48". Drive gear 48" engages a roller drive gear 70, which in turn drivingly engages roller drive gears 72 and 74. Roller drive gear 74 in turn drives roller drive gear 76.

The directions of motion of the two endless loops 30 are typically as shown, although the directions of one or both may be reversed, by suitable modification of the gearing.

Figure 9A:
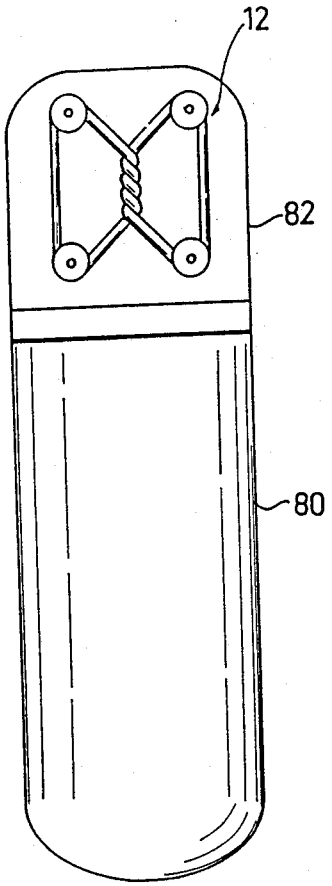
FIGS. 9A and 9B are plan view illustrations of a modular head depilatory device constructed and operative in accordance with yet another preferred embodiment of the invention in respective assembled and disassembled orientations.
Figure 9B:
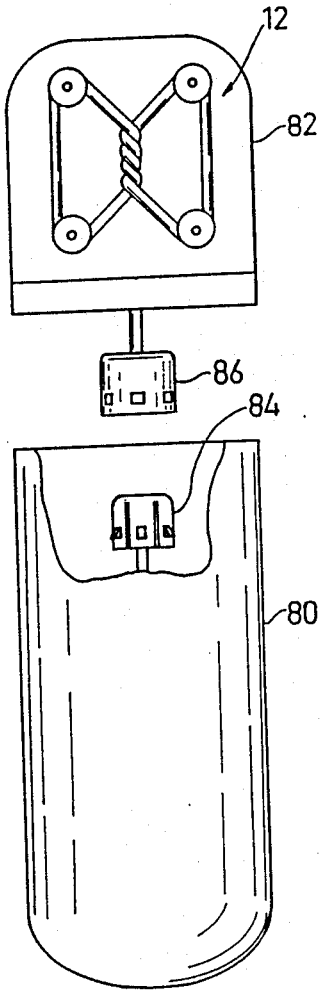

Reference is now made to FIGS. 9A and 9B which illustrate a modular head depilatory device which includes a driver portion 80 and a replaceable head portion 82. The two portions may be removably snap fit together and the motor drive may be removably coupled by means of a removable snap fit rotary drive connection assembly including a male element 84 and a female element 86 as illustrated. Alternatively, any other suitable type of coupling assembly may be employed. The hair engagement and removal assembly 12 may be identical to that shown in FIGS. 6A and 6B.

Figure 11:
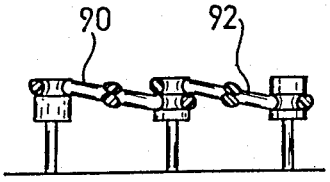
FIG. 11 is a sectional illustration taken along the lines XI—XI of FIG. 10.
Figure 10:
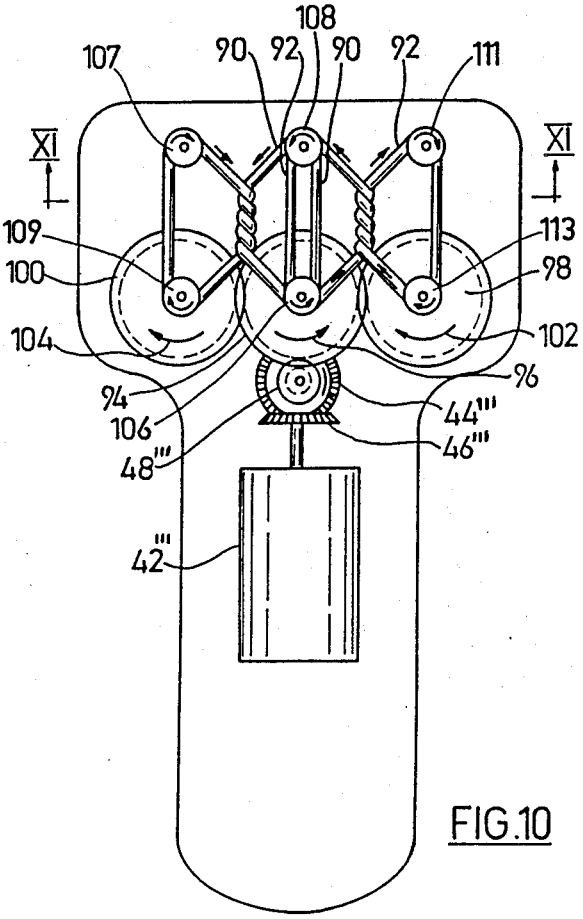
FIG.10 is a plan view illustration of a depilatory device constructed and operative in accordance with yet another preferred embodiment of the invention.

Reference is now made to FIGS. 10 and 11, which illustrate a depilatory device constructed and operative in accordance with a further alternative embodiment of the invention in which two endless loops 90 and 92 are employed. A motor 42''' provides a rotary output via bevel gears 44''' and 46''' and a drive gear 48'''. Drive gear 48 drivingly engages a roller drive gear 94 for rotating it in a first direction, such as the direction indicated by arrow 96. Roller drive gear 94 drivingly engages roller drive gears 98 and 100, driving them in an opposite sense to the rotation of gear 94, as indicated by respective arrows 102 and 104.

Roller drive gear 94 drives a roller 106 together therewith. Roller 106 drivingly supports both endless loops 90 and 92, which are also supported on a roller 108, driving them in opposite directions, as indicated by the arrows placed alongside the loops. Loop 90 is additionally supported on rollers 107 and 109, while loop 92 is additionally supported on rollers 111 and 113. Roller 113 is driven by roller drive gear 98, while roller 109 is driven by roller drive gear 100.

Figure 12:
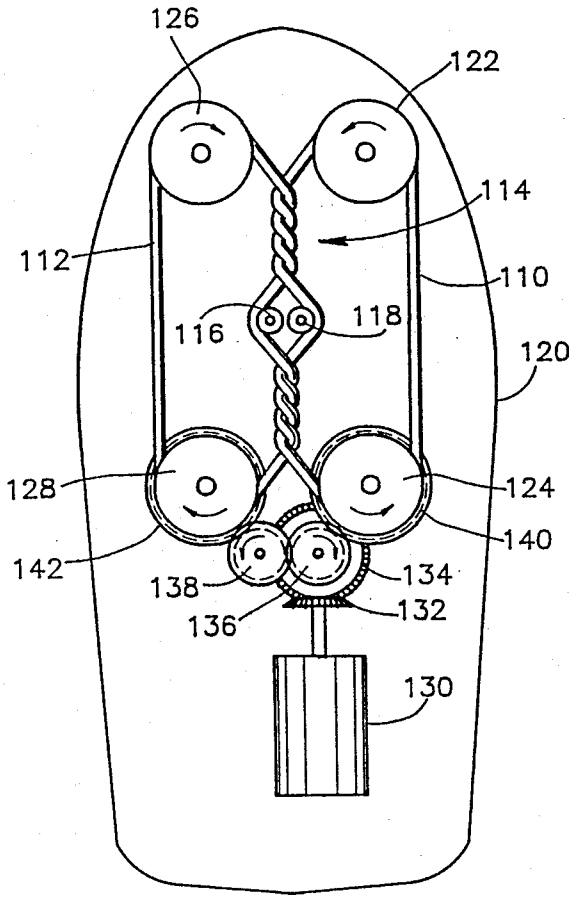
FIG. 12 is a plan view illustration of a depilatory device constructed and operative in accordance with still another preferred embodiment of the invention.

Reference is now made to FIG. 12, which illustrates a depilatory device constructed and operative in accordance with a further alternative embodiment of the invention in which two endless loops 110 and 112 are employed. Loops 110 and 112 are typically untwisted endless loops which are subsequently twisted together to define a twisted engagement, indicated generally by reference numeral 114. Loops 110 and 112 are typically maintained in the desired twisted engagement 114 by means of a pair of rollers 116 and 118 which are pivotably mounted onto a housing 120.

Loop 110 is mounted onto rollers 122 and 124, while loop 112 is mounted onto rollers 126 and 128. All of rollers 122–128 are rotatably mounted onto housing 120. An electric motor 130 drives rollers 124 and 128 via bevel gears 132 and 134, intermediate drive gears 136 and 138 and drive gears 140 and 142, associated with respective rollers 124 and 128.

Figure 13:
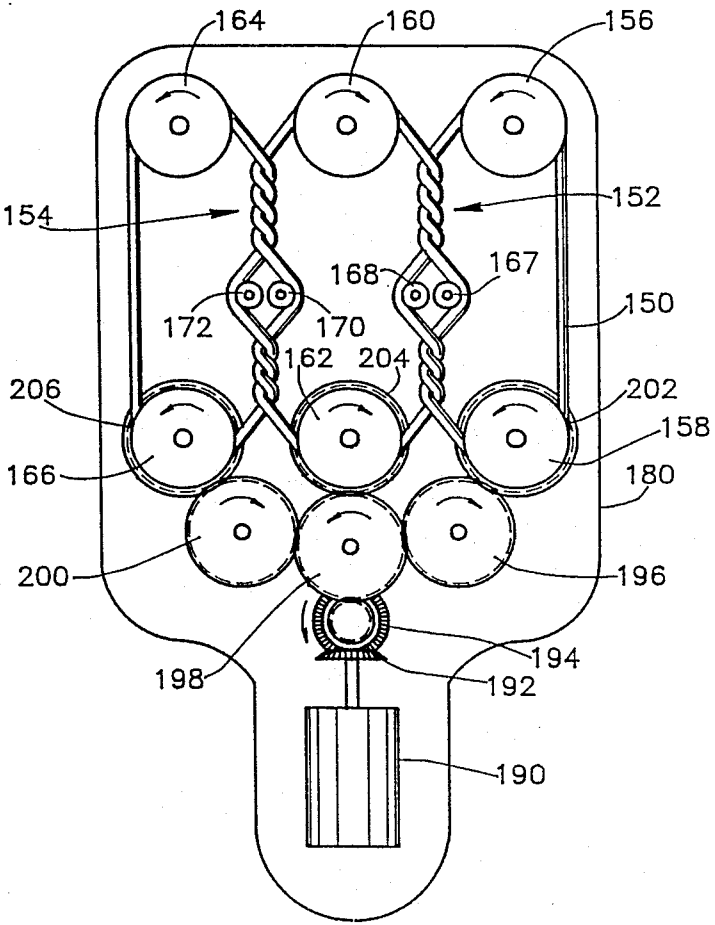
FIG. 13 is a plan view illustration of a depilatory device constructed and operative in accordance with yet another preferred embodiment of the invention.

Reference is now made to FIG. 13, which illustrates a depilatory device constructed and operative in accordance with yet another alternative embodiment of the invention in which a single endless loop 150 is employed. Similarly to the embodiment of FIG. 13, loop 150 is typically an untwisted endless loop which is subsequently twisted. In the embodiment of FIG. 13, loop 150 is twisted at two separate locations to define first and second twisted engagements, indicated generally by reference numeral 152 and 154. Loop 150 is supported on six rollers, indicated by reference numerals 156, 158, 160, 162, 164 and 166. The twisted engagements 152 and 154 are each maintained by respective roller pairs 167 and 168, and 170 and 172, as illustrated. All of the rollers 156–172 are pivotably mounted onto a housing 180.

An electric motor 190 drives rollers 158, 162 and 166 via bevel gears 192 and 194, intermediate drive gears 196, 198 and 200 and drive gears 202, 204 and 206, associated with respective rollers 158, 162 and 166.

It will be appreciated by persons skilled in the art that the present invention is not limited to what has been particularly shown and described hereinabove. The various embodiments described and illustrated above may be combined in any suitable combination, even though such combination is not expressly shown or described. Various other embodiments may occur to persons reading the foregoing description which are not presented here but nevertheless fall within the scope of the present invention. The scope of the present invention is defined only by the claims which follow:

We claim:

1. An electrically powered depilatory device comprising:

a hand held portable housing;

a hair engagement and removal assembly including elongate elements in mutually twisted engagement; and motor means for driving the elongate elements in motion, whereby hair is engaged between the elongate elements and thus removed, and wherein said elongate elements form parts of a plurality of endless loops.

2. An electrically powered depilatory device according to claim 1 and wherein when driven by said motor means said mutually twisted elongate elements are operative to wind hair in engagement therewith.

3. An electrically powered depilatory device according to claim 2 and wherein the motion of the elongate elements is such that the hair is wound in engagement with the elongate elements at a location separated from the location at which it is initially engaged thereby.

4. Apparatus according to claim 1 and wherein the arrangement of the elongate elements in mutually twisted engagement is such that when driven by the motor apparatus, the engagement and removal assembly undergoes continuous twisting action.

5. An electrically powered depilatory device according to claim 1 and wherein said motor means is operative to draw the elongate elements through the twisted engagement, whereby given regions of the elongate elements enter mutually twisted engagement and subsequently leave such engagement.

6. An electrically powered depilatory device according to claim 5 and wherein the locations at which given regions of the elongate elements enter and leave mutually twisted engagement are spaced from each other.

7. An electrically powered depilatory device according to claim 1 and wherein the arrangement of the elongate elements in mutually twisted engagement and the driving thereof by the motor means is such that the elongate elements move forward in a generally spiral type motion and rotate about their elongate axes as they move through mutually twisted engagement.

8. An electrically powered depilatory device according to claim 1 and wherein said elongate elements form part of a single endless loop.

9. Apparatus according to claim 1 and wherein the twisted engagement comprises at least one coil.

10. Apparatus according to claim 1 and wherein said twisted engagement comprises multiple coils.

11. Apparatus according to claim 1 and wherein the arrangement of the engagement and removal assembly is such that the twisted engagement extends generally linearly.

12. Apparatus according to claim 1 and wherein said hair engagement and removal assembly comprises a plurality of hair engagement and removal devices.

13. Apparatus according to claim 12 and wherein said plurality of hair engagement and removal devices operate in different directions of motion.

14. Apparatus according to claim 1 and wherein said hair engagement and removal assembly is replaceably removable from at least part of said housing.

15. Apparatus according to claim 1 and wherein said mutually twisted engagement is provided by twisting together elongate elements which form part of at least one endless loop.

16. Apparatus according to claim 15 and also comprising means engaging said elongate elements in said mutually twisted engagement for maintaining said mutually twisted engagement.

17. Apparatus according to claim 1 and wherein said mutually twisted engagement is provided by twisting together elongate elements and subsequently joining them to form at least one endless loop.

18. An electrically powered depilatory device comprising:

a hand held portable housing;

a hair engagement and removal assembly including elongate elements in mutually twisted engagement; and motor means for driving the elongate elements in motion, whereby hair is engaged between the elongate elements and thus removed, and wherein the arrangement of the engagement and removal assembly is such that the location of the twisted engagement remains generally static relative to the housing.

19. An electrically powered depilatory device according to claim 18 and wherein when driven by said motor means, said mutually twisted elongate elements are operative to wind hair in engagement therewith.

20. An electrically powered depilatory device according to claim 19, and wherein the motion of the elongate elements is such that the hair is wound in engagement with the elongate elements at a location separated from a location at which it is initially engaged thereby.

21. Apparatus according to claim 18 and wherein the arrangement of the elongate elements in mutually twisted engagement is such that when driven by the motor means, the engagement and removal assembly undergoes continuous twisting action.

22. An electrically powered depilatory device according to claim 18 and wherein said motor means is operative to draw the elongate elements through the twisted engagement, whereby given regions of the elongate elements enter mutually twisted engagement and subsequently leave said engagement.

23. An electrically powered depilatory device according to claim 22, and wherein the locations at which given regions of the elongate elements enter and leave mutually twisted engagement are spaced from each other.

24. An electrically powered depilatory device according to claim 18, and wherein the arrangement of the elongate elements in mutually twisted engagement and the driving thereof by the motor means is such that the elongate elements move forward in a generally spiral type motion and rotate about elongate axes thereof as the elongate elements move through mutually twisted engagement.

25. An electrically powered depilatory device according to claim 18 and wherein said elongate elements form part of a single endless loop.

26. Apparatus according to claim 18 and wherein the twisted engagement comprises at least one coil.

27. Apparatus according to claim 18 and wherein said twisted engagement comprises multiple coils.

28. Apparatus according to claim 18 and wherein the arrangement of the engagement and removal assembly is such that the twisted engagement extends generally linearly.

29. Apparatus according to claim 18, and wherein said elongate elements form a loop of flexible material which is mounted on a plurality of rollers, at least some of which are coupled to said motor means for being driven thereby.

30. Apparatus according to claim 18 and wherein said hair engagement and removal assembly comprises a plurality of their engagement and removal devices.

31. Apparatus according to claim 30 and wherein said plurality of hair engagement and removal devices are arranged to operate in different directions of motion.

32. Apparatus according to claim 18 and wherein said hair engagement and removal assembly is replaceably removable from at least part of said housing.

33. Apparatus according to claim 18 and wherein said mutually twisted engagement is provided by twisting together elongate elements which form part of at least one endless loop.

34. Apparatus according to claim 33 and further comprising means engaging said elongate elements in said mutually twisted engagement for maintaining said mutually twisted engagement.

35. Apparatus according to claim 18 and wherein said mutually twisted engagement is provided by twisting together elongate elements and subsequently joining them to form at least one endless loop.

36. An electrically powered depilatory device comprising:

a hand held portable housing;

a hair engagement and removal assembly including elongate elements in mutually twisted engagement; and motor means for driving the elongate elements in motion, whereby hair is engaged between the elongate elements and thus removed, and wherein said elongate elements form a loop of flexible material which is mounted on a plurality of rollers, at least some of which are coupled to said motor means for being driven thereby.

* * * * *